US007801475B2

(12) United States Patent
Biegelsen et al.

(10) Patent No.: US 7,801,475 B2
(45) Date of Patent: Sep. 21, 2010

(54) ULTRA-HEATED/SLIGHTLY HEATED STEAM ZONES FOR OPTIMAL CONTROL OF WATER CONTENT IN STEAM FUSER

(75) Inventors: David K. Biegelsen, Portola Valley, CA (US); Armin R. Volkel, Mountain View, CA (US); Ashish Pattekar, Cupertino, CA (US); Lars-Erik Swartz, Sunnyvale, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 481 days.

(21) Appl. No.: 11/959,394

(22) Filed: Dec. 18, 2007

(65) Prior Publication Data

US 2009/0154968 A1 Jun. 18, 2009

(51) Int. Cl.
*G03G 15/20* (2006.01)

(52) U.S. Cl. ..... 399/335; 399/107; 399/110; 399/122; 399/320

(58) Field of Classification Search ..... 399/107, 399/110, 122, 320, 335
See application file for complete search history.

(56) References Cited

U.S. PATENT DOCUMENTS 4,054,410 A * 10/1977 Murphy ..... 432/60
4,693,588 A * 9/1987 Yarbrough et al. ..... 399/93
4,922,304 A * 5/1990 Gilbert et al. ..... 399/322
2001/0048829 A1* 12/2001 Hamilton et al. ..... 399/331
2009/0154969 A1* 6/2009 Biegelsen et al. ..... 399/335
2009/0274499 A1* 11/2009 Kovacs et al. ..... 399/335
2010/0111549 A1* 5/2010 Condello et al. ..... 399/45

* cited by examiner

*Primary Examiner*—David P Porta
*Assistant Examiner*—Jessica L Eley
(74) *Attorney, Agent, or Firm*—Bever, Hoffman & Harms, LLP; Patrick T. Bever

(57) ABSTRACT

A dual-zone steam fuser for a xerographic system includes a ultra-heated first zone maintained at 200-500° C. that quickly heats a paper substrate to an optimal toner fusing temperature (e.g., 120-150° C.), and a second, relatively cool second zone for maintaining the substrate at the optimal temperature during completion of the fusing process. A conveying system conveys the substrate so that it exits the first zone and enters the second zone immediately after the substrate temperature reaches the optimal toner fusing temperature, and is maintained in the second zone for a predetermined fusing operation time period. The gas (e.g., steam) temperatures and timing are selected such that surface condensation is minimized during initial heating, and such that moisture content is normalized at the end of the fusing process.

11 Claims, 4 Drawing Sheets

ULTRA-HEATED/SLIGHTLY HEATED STEAM ZONES FOR OPTIMAL CONTROL OF WATER CONTENT IN STEAM FUSER

FIELD OF THE INVENTION

This invention relates to xerographic or electrostatographic systems, and in particular to steam fusers for such systems.

BACKGROUND OF THE INVENTION

In xerographic or electrostatographic printers (collectively referred to herein as "xerographic systems), a charge-retentive member is charged to a uniform potential and thereafter exposed to a light image of an original document to be reproduced. The exposure discharges the charge-retentive surface in exposed or background areas and creates an electrostatic latent image on the member which corresponds to the image areas contained within the original document. Subsequently, the electrostatic latent image on the charge-retentive surface is rendered visible by developing the image with developing powder. Many development systems employ a developer material which comprises both charged carrier particles and charged toner particles which triboelectrically adhere to the carrier particles. During development, the toner particles are attracted from the carrier particles by the charge pattern of the image areas on the charge-retentive area to form a powder image on the charge-retentive area. This image is subsequently transferred to a substrate (e.g., a sheet of paper), which is then transferred through a fuser to permanently affix the toner to the substrate by applying heat and/or pressure that causes the temperature of the toner material to be elevated to a temperature at which the toner material coalesces and becomes tacky. This heating causes the toner to flow to some extent into the fibers or pores of the substrate. Thereafter, as the toner material cools, solidification of the toner material causes the toner material to become bonded to the substrate.

Xerographic systems utilize either contact type fusers, such as the pressure fuser mentioned above, or contactless systems such as flash, radiant or steam fusers to fix toner material to a substrate.

In contact type fusers, the substrate is pressed between two rollers, at least one of which is heated to a temperature high enough to cause the toner to bind to the substrate. However, contacting methods are problematic because they result in poor heat coupling to the media due to media roughness and a trapped air layer between the media and the heat transfer surface.

Steam fusers utilize a steam oven to rapidly heat the substrate to the desired temperature in order to affix the toner. The cool substrate leaves the toner transfer apparatus and is directed into a steam oven containing steam at a temperature of approximately 180° C.±20° C.). The substrate is thus heated by steam condensation and concomitant release of latent heat, as well as by convective heat transfer to the desired temperature. During the first moments of this heating process, until the substrate surface temperature approaches the boiling point of water at the operating pressure, heating of the substrate is predominantly achieved through steam condensation heat transfer, which usually occurs in a time of order of 100 milliseconds (ms), independent of steam temperature. A condensate liquid layer approximately 4 microns thick (dependent on the heat capacitance of the substrate) results during this condensation heating process that must be re-evaporated and before the substrate can be heated above the boiling point (e.g., 100° C.). Re-evaporation of the condensate liquid layer takes about one second, during which this liquid layer can be rapidly imbibed by capillary infusion into the fiber matrix of the substrate (if uncoated). When the moisture content at the center of a substrate exceeds a level of approximately 10% by weight, the fibers are able to move and relax non-uniform stresses (built into the paper during manufacture by cooling and quenching-in the non-uniform stresses under pressure.) This is called cockling and is undesirable. Once the cockling appears, subsequent drying of the paper is not effective in reversing the distortion. Further, if the time in a superheated steam oven needs to be long compared to the heating time (e.g., to allow capillary reflow of molten toner to achieve desired gloss in fusing applications), excessive drying of the native moisture content of the substrate can occur. Excessive drying can cause sheet dimensional changes, discoloration, curling, and other physical changes of the substrate.

What is needed is a steam fuser for a xerographic system in which the substrate can be heated rapidly without building up an appreciable thickness of water on the surface (minimizing the 'condensation zone' time in the steam oven in order to minimize cockle), yet allowing the substrate to be subsequently held at a desired temperature for a desired time period with minimal reduction in moisture content.

SUMMARY OF THE INVENTION

The present invention is directed to a steam fuser for a xerographic system that includes an ultra-heated first steam zone (chamber) that is maintained at a temperature greater than 200° C., say, a relatively cool second zone (chamber) maintained by steam, hot air or other gas at a second temperature that is ~130° C., depending on the viscosity of the toner being used, and a conveyor system for moving the substrate through the first and second zones at a rate that is determined to both optimize the fusing process and minimize moisturization of the substrate. The ultra-heated steam zone quickly heats the substrate using high convective heat transfer rates that quickly re-evaporate the liquid water condensing on the substrate surface, thereby minimizing the net amount of water accumulation and reducing the level of moisture rise within the substrate in comparison to conventional single-zone steam fusing apparatus. Minimizing condensation build up minimizes infusion into the substrate, and thus minimizes cockling. It further reduces the time to increase the substrate temperature above the boiling point of the water, and to the optimal holding temperature required for the subsequent process step(s) such as toner reflow for glossing. The conveyer system transfers the substrate out of the ultra-heated first steam zone immediately after the optimal temperature is reached but before the substrate moisture has returned to its original (pre-heated) state. The substrate then passes through the second zone at a rate that maintains the optimal fusing temperature for an optimal time period to both complete the fusing process, and to eject the substrate (i.e., return the substrate to a room temperature environment) just as its moisture content returns to its initial level. By completing the fusing process with the substrate having approximately the same moisture content as when it entered the steam fuser, and by keeping the moisture content rise during processing to a minimum, the present invention enables the use of steam for heating paper substrates while at the same time minimizing the distortion (cockle/waviness) that might appear due to moisturization of the substrate.

In accordance with an embodiment of the present invention, the dual-zone steam fuser apparatus is disposed downstream from an image toner transfer portion of a host xerographic system. The dual-zone steam fuser apparatus includes a housing having an outer wall and an inner wall that separates two chambers. An ultra-heated steam (e.g., in the range of 200-500° C.) is injected into the first chamber from a first steam source, and a second gas or vapor having a temperature in the range of 120-150° C. is injected into the second chamber from a second source. The substrate is conveyed into the first chamber by a first transport mechanism (e.g. rollers) disposed outside the outer wall of the housing, from the first chamber into the second chamber by another set of rollers disposed on or near the inner wall, and from the second chamber to an external region by other sets of rollers disposed within the housing. One or more additional roller sets may be included inside the first and second chambers to facilitate reliable and accurate transfer of the substrate through the dual-chamber steam fuser apparatus. It should also be noted that the present invention works well with web fed substrates (as opposed to cut sheets) where the substrate is suspended within the zones and is fed continuously through. The length of each chamber, the steam temperature, and the speed of the conveying mechanism are coordinated to achieve the goals of minimizing moisture content rise, and completing the fusing process with the substrate having approximately the same moisture content as when it entered the steam fuser.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in steam fuser apparatus for xerographic systems. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
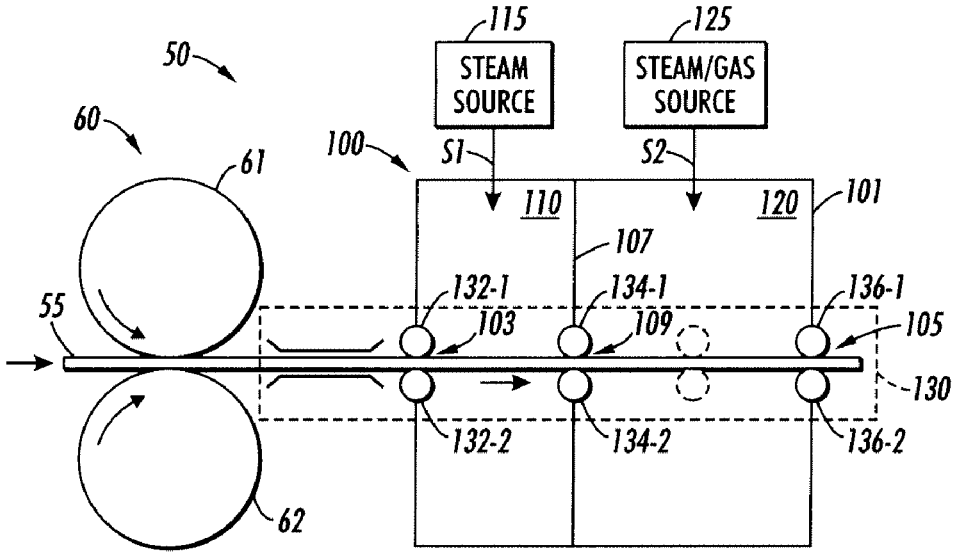
FIG. 1 is a simplified side view showing a portion of a xerographic system incorporating a dual-zone steam fuser apparatus according to an embodiment of the present invention.

FIG. 1 is a simplified side view showing a portion of a xerographic system 50 including a two-zone steam fuser apparatus 100 according to an embodiment of the present invention. Steam fuser 100 is positioned immediately downstream of a toner transfer device 60 that utilizes two rotating drums 61 and 62 to transfer toner onto a substrate 55 in a predetermined pattern according to known xerographic techniques. As in conventional xerographic systems, two-zone steam fuser 100 serves to heat substrate 55 to a predetermined optimal fusing temperature (e.g., approximately 120-150° C.), and to maintain substrate 55 at or above the predetermined temperature for a predetermined time period in order to facilitate melting of the toner and fusing of the toner to substrate 55.

Steam fuser 100 generally includes a fuser oven 101 including a first steam zone (chamber) 110 and a second zone (chamber) 120, and also includes a conveying mechanism 130 for transporting substrate 55 through first steam zone 110 and a second zone 120. In the exemplary embodiment of FIG. 1, conveying mechanism 130 is at least partially incorporated into fuser oven 101.

In one embodiment, steam fuser 100 utilizes water-based steam at approximately atmospheric pressure, whereby the boiling temperature of the steam is approximately 100° C. In other embodiments, heating fluids other than water may be utilized that have a different boiling point temperature. Further, steam fuser 100 may be maintained at a higher pressure or lower pressure which would cause a concomitant reduction or increase of the boiling point temperature.

Fuser oven 101 includes an outer wall defining an entry (first) opening 103 communicating with the first steam zone 110, and an exit (second) opening 105 communicating with second zone 120. Oven 101 also includes an inner wall or other barrier 107 that defines a third opening 109 communicating between zones 110 and 120.

As indicated above fuser oven 101, in one specific embodiment two steam sources 115 and 125 are utilized to inject steam into corresponding zones 110 and 120. Steam source 115 injects ultra-heated steam S1 into steam zone 110, and steam source 125 injects relatively cool steam S2 into second zone 120 (in alternative embodiments, a gas or vapor is injected by a corresponding gas heating unit into second zone 120). In one embodiment, steam S1 has a temperature greater than approximately 200° C., and more preferably has a temperature in the range of 400-500° C., and steam (or other gas/vapor) S2 has a temperature less than approximately 150° C., and more preferably has a temperature in the range of 120-150° C. Steam sources 115 and 125 are constructed using conventional materials and utilize conventional steam generating methods.

In the exemplary embodiment, conveying mechanism 130 utilizes a series of rollers to convey substrate 55 from toner transfer device 60 through dual-zone steam fuser apparatus 100. In particular, conveying mechanism 130 includes a first roller pair 132-1 and 132-2 disposed in entry opening 103 for conveying the substrate into first steam zone 110, a second roller pair 134-1 and 134-2 disposed in opening 109 for conveying the substrate between first steam zone 110 and second steam zone 120, and a third roller pair 136-1 and 136-2 disposed in exit opening 105 for conveying the substrate out of second steam zone 120. The spacing and construction of suitable rollers are known to those skilled in the art. In a specific embodiment, the rollers are constructed in accordance with co-owned and co-pending U.S. patent application Ser. No. 11/614,370, filed Dec. 21, 2006, entitled "Transport for Printing Systems", which is incorporated herein by reference in its entirety.

In accordance with an embodiment of the present invention, the temperatures of steam S1 and S2, the length of steam zones 110 and 120, and the speed of conveying mechanism 130 are selected to convey substrate 55 such that, when substrate 55 exits first steam zone 110, its surface temperature is approximately equal to the predetermined optimal fusing temperature (e.g., 130° C.), and when substrate 55 exits second steam zone 120, its surface temperature has been maintained approximately equal to the predetermined optimal fusing temperature for a predetermined time period that produces complete fusing of the toner (or other) material to substrate 55, and also minimizes moisture change between when substrate 55 enters steam zone 110 and when it exits steam zone 120. These optimal characteristics are described below with reference to FIG. 2.

In one embodiment, one or more sensors (not shown) are disposed inside one or more of zones 110 and 120, or disposed outside oven 101, and serve to measure the temperature and/or moisture content of substrate 55, and to feed back this information to a process controller (not shown), which is turn modulates the flows and temperatures of steam S1 and S2 (or other gases) and/or the transport speed of substrate 55 by conveyor 130 in order to optimize the fusing process. Moreover, the amount of condensation allowed in first steam zone 110 is optionally varied so as to compensate for the moisture loss in second zone 120.

Figure 2:
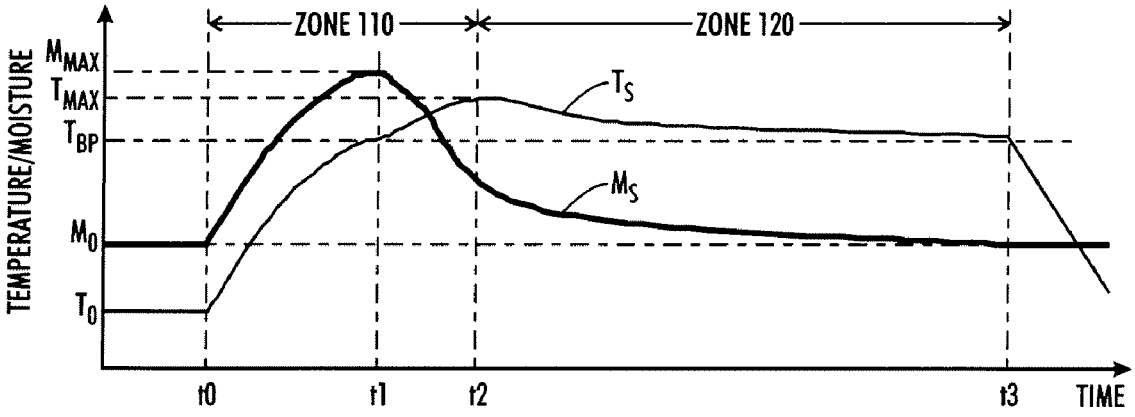
FIG. 2 is a graph showing temperature and moisture content of a substrate passing through the dual-zone steam fuser apparatus shown in FIG. 1.

FIG. 2 is a graph showing the temperature and moisture content of substrate 55 as it passes through dual-zone steam fuser 100 of FIG. 1. The dashed line $T_S$ indicates the temperature of the substrate before, during and after the fusing process, and the solid line $M_S$ indicates the moisture content of the substrate before, during and after the fusing process. The initial temperature $T_0$ and moisture content $M_0$ respectively indicate the substantially room temperature and normal moisture content of the substrate that are present after the toner transfer operation and just before entering dual-zone steam fuser 100. The curves shown in FIG. 2 indicate how the temperature and moisture content of the substrate are changed during the fusing process as the substrate passes through dual-zone steam fuser 100.

As depicted on the left side of FIG. 2, when the substrate enters first "ultra-heated" steam zone 110 at time t0, the substrate temperature (indicated by short dashed line $T_S$) begins to rise from an initial (entry-point) temperature $T_0$ toward the steam boiling point temperature $T_{BP}$ at a rate that is nearly independent of the steam temperature. In the present example, in which water is used to generate the steam and dual-zone steam fuser 100 is maintained at approximately one atmosphere, the steam boiling point temperature $T_{BP}$ is approximately 100° C. (The boiling point temperature for the water in contact with a porous or rough paper surface is elevated above 100° C. and is dependent on the details of the paper porosity.) Similarly, as indicated by the solid line curve $M_S$ in FIG. 2, the substrate enters first zone 110 at time t0 with an initial moisture content $M_0$, and the moisture content $M_S$ begins to increase as a liquid layer forms on the substrate due to steam condensation. As indicated by the solid line curve $M_S$, the substrate moisture content reaches a maximum level M1 at time t1, which is approximately when the temperature of substrate 55 reaches boiling point temperature $T_{BP}$. In accordance with an aspect of the present invention, the competitive re-evaporation process due to convective heat transfer from ultra-heated steam S1 limits the thickness of the condensate. The thickness growth slows and goes to zero (i.e., reaches a peak moisture value $M_{MAX}$) near the boiling point temperature $T_{BP}$ (e.g., 100° C.). If Ts were equal to TBP the rate of condensation would equal the rate of re-evaporation and the condensate amount would reach an asymptotic value and stay there. The rate of re-evaporation equals the condensation rate at a considerably lower temperature (the balance point). All the latent heat supplied to the substrate by condensation is regained by the condensate through the heat transferred via convective heat transfer from the ultra-heated steam and the heat flux into the paper is supplied through convective heat transfer only. Above the balance point temperature $T_{BP}$, and at a time, $t_1$, the convective heat transfer due to the ultra-heated steam S1 exceeds the heat flux into the substrate, and the accumulated liquid starts to evaporate, which is indicated by the drop in the solid line moisture content curve $M_S$ between time t1 and time t2. Similarly, as indicated by the dashed-line substrate temperature curve $T_S$, once the accumulated liquid layer thickness starts to decrease as the layer is re-evaporated, the ultra-hot steam of zone 110 heats the surface of the substrate above the boiling point temperature $T_{BP}$. According to a first aspect, the length of first steam zone 110 (and/or the speed at which conveyor system 130 conveys substrate 55 through first steam zone 110; see FIG. 1) is selected such that when the substrate reaches a predetermined maximum temperature $T_{MAX}$ (e.g., 130° C.), the substrate leaves first zone 110 and enters second zone 120 (i.e., at time t2 in FIG. 2).

Second zone 120 provides an environment that maintains the substrate at the desired temperature while minimizing moisture loss. The cooler temperature of second zone 120 causes the substrate temperature to stabilize at or near the predetermined maximum temperature $T_{MAX}$, which is selected as the desired temperature for facilitating the fusing process. Similarly, the cooler temperature of second steam zone 120 slows the substrate drying process (i.e., the reduction in moisture that began at time t1). That is, the evaporation of water from the substrate that was started in ultra-heated zone 110 continues in second zone 120, but at a much lower rate than if the sheet had remained in ultra-heated zone 110. (In fact, if the system were to halt with paper in the ultra-heated zone 110, the substrate could be dried and could become a fire hazard in the presence of air/oxygen. If the steam flow is high enough to effectively exhaust oxygen/air from the zone, the possibility of ignition could be reduced/eliminated. However, a more failsafe control might be needed to avoid this danger.) According to another aspect of the invention, the length of second steam zone 120 (and/or the speed at which conveyor system 130 conveys substrate 55 through first steam zone 110; see FIG. 1) is selected such that the substrate is maintained at approximately the desired temperature $T_{MAX}$ for a predetermined time period needed to produce capillary reflow of the molten toner (e.g., on the order of approximately 1 second). The substrate 55 then exits second zone 120 and cools down to room temperature.

Figure 3A:
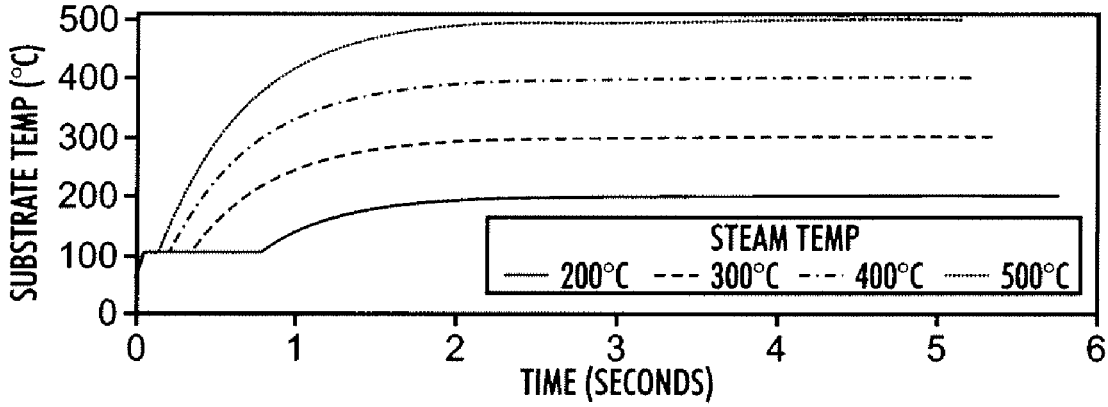
FIG. 3(A) (PRIOR ART)
FIGS. 3(A) and 3(B) are graphs showing substrate temperature and water film thickness associated with a conventional single-zone steam fuser.
Figure 3B:
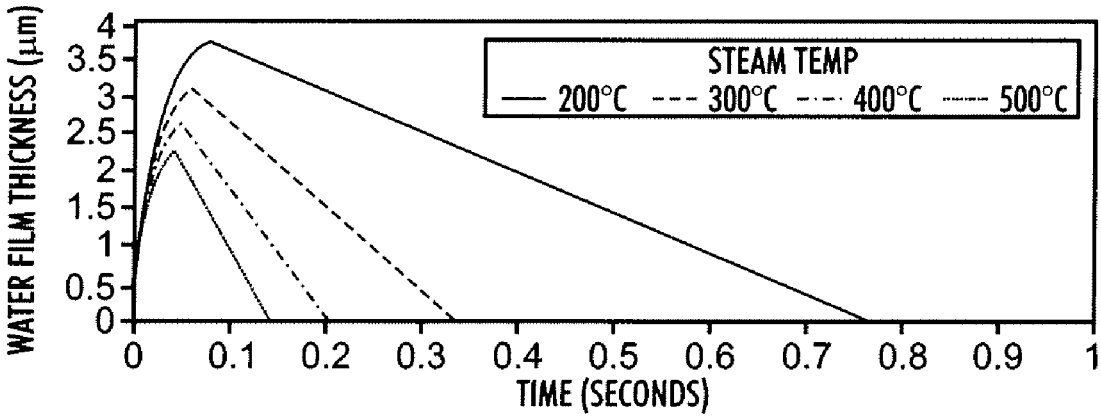
FIG. 3(B) (PRIOR ART)

More detail can be obtained from numerical simulations of the above-described process. The assumptions for the results reported below correspond to the conditions shown in FIGS. 1 and 2. The heat transfer parameters and conditions were:

condensation heat transfer: 2000 $W/m^2K$
convection heat transfer: 125 $W/m^2K$
paper thickness: 100 um
symmetric heating from both sides of the substrate FIGS. 3(A) and 3(B) are graphs showing the top surface temperature and accumulated water thickness for a substrate with a water-impermeable surface using a conventional steam fuser having a single temperature steam zone. (Note time scale change between the two graphs.) It can be seen that the thickness as well as residence time of the condensed layer is significantly less at higher steam temperatures, confirming that the convective heat transfer (proportional to Ts-Tcondensate) with ultra-heated steam is more effective in limiting the moisture buildup on the surface as the steam temperature is increased.

Figure 4A:
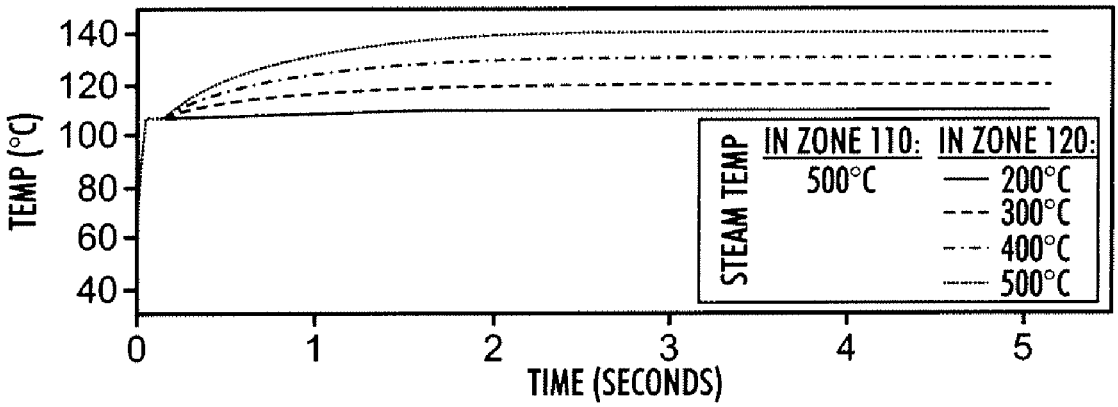
FIGS. 4(A) and 4(B) are graphs showing substrate temperature and water film thickness associated with the dual-zone steam fuser apparatus shown in FIG. 1.
Figure 4B:
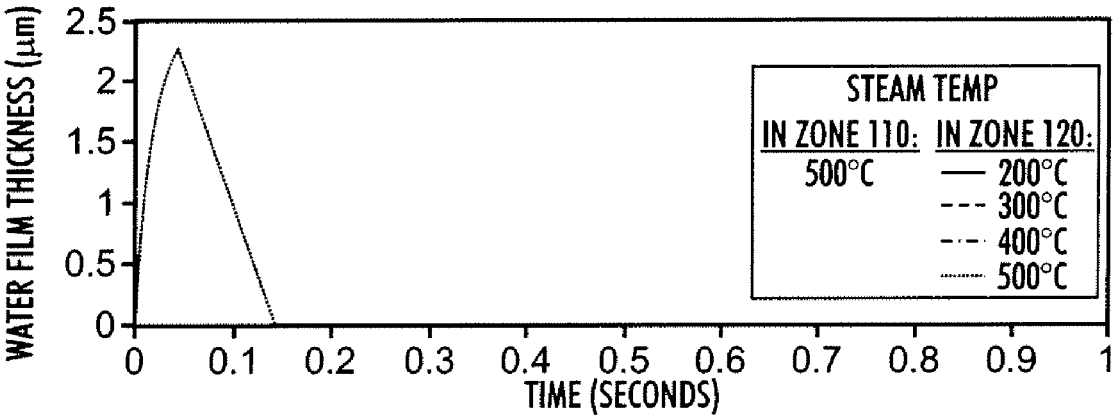

In the case of the dual-zone steam fuser of the present invention, as shown in the graphs of FIGS. 4(A) and 4(B), the initial ultra-heated steam zone enables rapid heating to 100°

C. without excessive moisture buildup during the initial ~100 ms, and the temperature of the substrate rises to the surface temperature within tens of ms. The temperature in the second zone rises with a time constant of roughly ~0.5 seconds. However, if the heating to the second zone temperature occurs in the first "ultra-heated" zone (with a slight increase in dwell time in the first zone), then the second zone just holds the temperature constant from the time of entry.

Figure 5:
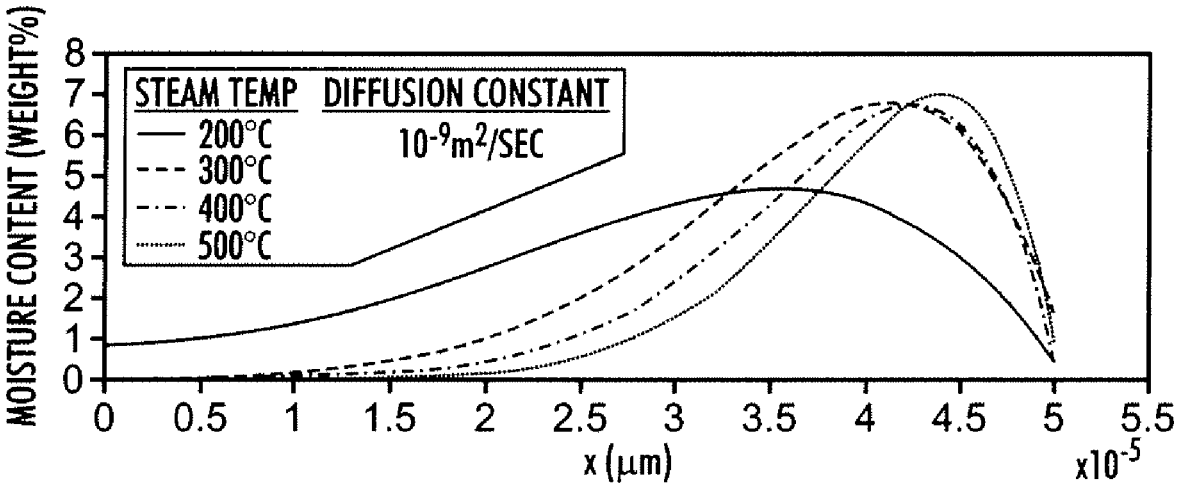
FIG. 5 is a graph showing moisture content in a substrate for various ultra-heated steam temperatures.

FIG. 5 is a graph showing the moisture content as a function of depth in a porous substrate 55. Zero corresponds to the center of the sheet. The 'end of simulation' is the point where a surface liquid layer no longer exists. It can be seen that for steam temperatures of 300° C. and above the moisture at the center is reduced greatly, so that cockling should be negligible if the diffusion coefficient of moisture in the substrate is in the assumed range of $10^{-9}$ $m^2/s$. Higher diffusivities require higher steam temperatures to achieve the shown behavior.

Although the present invention has been described with respect to certain specific embodiments, it will be clear to those skilled in the art that the inventive features of the present invention are applicable to other embodiments as well, all of which are intended to fall within the scope of the present invention.

The invention claimed is:

1. A steam fuser apparatus for heating a substrate in a xerographic system to a predetermined temperature and for maintaining the substrate approximately at the predetermined temperature for a predetermined time, the predetermined temperature being above a steam boiling point temperature, the steam fuser apparatus comprising:

a first steam zone containing a first steam maintained at an ultra-heated temperature that is substantially higher than the predetermined temperature;

a second zone containing a second gas maintained at a second temperature that is substantially lower than the ultra-heated temperature; and means for conveying the substrate through the first steam zone and the second zone such that, when the substrate exits the first steam zone, a temperature of the substrate is approximately equal to the predetermined temperature, and when the substrate exits the second zone, the temperature of the substrate has been maintained approximately equal to the predetermined desired temperature for approximately the predetermined desired time.

2. The steam fuser of claim 1, wherein the second gas is one of steam and air.

3. The steam fuser of claim 1, further comprising a housing including an outer wall defining a first opening communicating with the first steam zone, and defining a second opening communicating with the second zone, the housing also including an inner wall defining a third opening communicating between the first steam zone and the second zone.

4. The steam fuser of claim 1 further comprising:

means for supplying steam at a temperature greater than 200° C. to the first steam zone, and means for supplying steam at a temperature of 120-150° C. to the second steam zone.

5. The steam fuser of claim 1, wherein said means for supplying steam at a temperature greater than 200° C. to the first steam zone comprises means for supplying steam at a temperature in the range of 200-500° C.

6. A steam fuser apparatus for fusing a toner material to a substrate in a xerographic system, the steam fuser apparatus comprising:

a first chamber containing ultra-heated steam having a first temperature greater than 200° C.;

a second chamber containing a gas at a second temperature less than 150° C.; and means for conveying the substrate through the first and second chambers such that, when the substrate exits the first chamber, the substrate is approximately at an optimal fusing temperature, and when the substrate subsequently exits the second chamber, the substrate is approximately at the optimal fusing temperature and the toner is fully fused to the substrate.

7. The steam fuser apparatus of claim 6, wherein, further comprising a housing including an outer wall defining a first opening communicating with the first chamber, and defining a second opening communicating with the second chamber, the housing also including an inner wall defining a third opening communicating between the first and second chambers.

8. The steam fuser of claim 7, wherein said means for conveying comprises:

a first roller pair disposed in said first opening for conveying the substrate into the first chamber, a second roller pair disposed in said third opening for conveying the substrate between the first and second chambers, and a third roller pair disposed in said third opening for conveying the substrate out of the second chamber.

9. The steam fuser of claim 6, wherein said first temperature of said ultra-heated steam is in the range of 400-500° C., and said second temperature of said second steam is in the range of 120-150° C.

10. A method for fusing a toner material onto a substrate in a xerographic system, the method comprising:

heating said substrate using ultra-heated steam having a first steam temperature that is greater than 300° C. until a temperature of said substrate is greater than 100° C.; and maintaining the temperature of said substrate above 100° C. using second steam having a second steam temperature that is less than 150° C. until toner is fused to said substrate.

11. The method according to claim 10, wherein heating said substrate further comprises minimally increasing a moisture content of said substrate from an initial moisture content, and wherein the method further comprises cooling said substrate to room temperature after the toner is fused and before a moisture content of the substrate rises above a cockling threshold of said substrate or drops below the initial moisture content.

* * * * *